United States Patent [19]

Swan

[11] 4,420,907

[45] * Dec. 20, 1983

[54] SHALLOW DOUBLE HUNG WINDOW

[75] Inventor: Charles A. Swan, Seminole, Fla.

[73] Assignee: Windows, Inc., Largo, Fla.

[ * ] Notice: The portion of the term of this patent subsequent to Dec. 16, 1997 has been disclaimed.

[21] Appl. No.: 217,987

[22] Filed: Dec. 18, 1980

Related U.S. Application Data

[63] Continuation-in-part of Ser. No. 216,813, Dec. 16, 1980, abandoned, which is a continuation of Ser. No. 923,344, Jul. 10, 1978, Pat. No. 4,238,907, which is a continuation-in-part of Ser. No. 758,866, Jan. 12, 1977, abandoned.

[51] Int. Cl.[3] ..... E05D 13/10

[52] U.S. Cl. ..... 49/446; 49/501; 49/404

[58] Field of Search ..... 49/446, 453, 380, 404, 49/501

[56] References Cited

U.S. PATENT DOCUMENTS

| | | | |
|---|---|---|---|
| 3,226,779 | 1/1966 | Rust | 49/453 X |
| 3,336,698 | 8/1967 | MacGregor | 49/380 |
| 4,238,907 | 12/1980 | Swan | 49/446 |

*Primary Examiner*—Kenneth Downey

*Attorney, Agent, or Firm*—Penrose, Lucas, Albright, Mason, Mason & Albright

[57] ABSTRACT

A shallow two inch deep double hung window which is sufficiently water and wind resistant to replace jalousies, which can be used in cabana walls and which fits screen porches, utilizing existing screening. Block and tackle sash balance counter balance the weight of individual panels and provide a lateral resilient action to maintain panels in position. A double action leaf spring stop for each panel selectively disengages the sash balances therefrom so that by moving a panel laterally it is removable. Window and panel frame members consist of aluminum extrusions which facilitate construction of custom windows made to selected sizes. Inside or outside flanges for securing the window to the wall structure are optionally provided.

7 Claims, 17 Drawing Figures

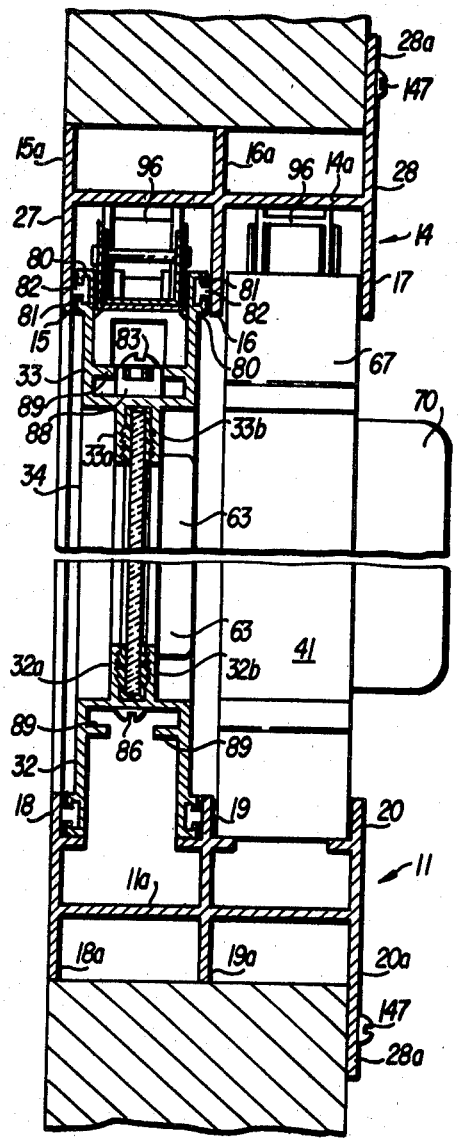
FIG. 3
FIG. 4A
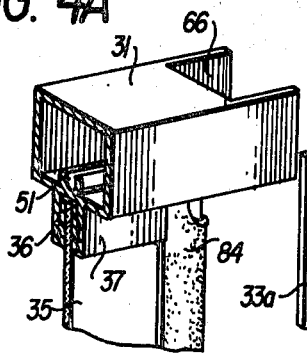
FIG. 4B
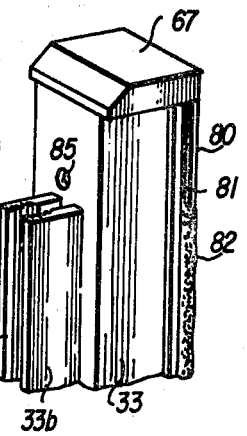
FIG. 4C
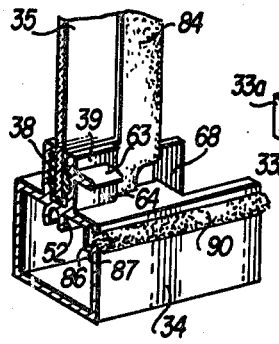
FIG. 4D
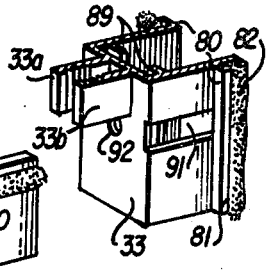
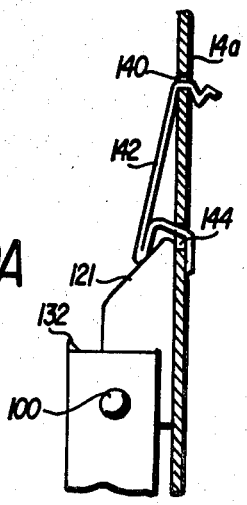
FIG. 9A
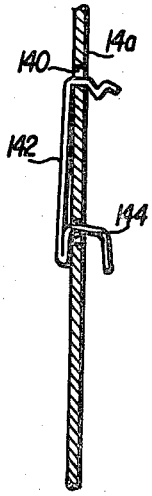
FIG. 9B

SHALLOW DOUBLE HUNG WINDOW

RELATED APPLICATIONS

This is a continuation-in-part of application Ser. No. 216,813 filed Dec. 16, 1980, now abandoned, which is a continuation of application Ser. No. 923,344 filed July 10, 1978, now U.S. Pat. No. 4,238,907 which is issued Dec. 16, 1980, which is a continuation-in-part of application Ser. No. 758,866, filed Jan. 12, 1977, now abandoned.

BACKGROUND OF THE INVENTION

The present invention relates to windows, more particularly to double hung windows.

In Florida, in particular, it has been found desirable to replace jalousies utilized in many residential homes by double hung windows and also to place such windows on screened-in porches. However, to make such a replacement without damage to interior plaster or paint, the double hung window must be shallow having a depth of only two inches. In addition, especially with screened-in porches, the dimensions for receipt of such windows may vary considerably from porch to porch and, moreover, between uprights in any particular porch. Such a shallow double hung window which is capable of withstanding high wind and rain storm loads without leakage or undue deformation has not been available previous to the arrangements presented in the present invention. However, as indicated, such a window would have particular utility to waterproof a screened porch wherein the screening is supported by two inch studs. The window of the invention is also useful for thin walls ordinarily utilized in cabana construction.

Pertinent prior art includes U.S. Pat. No. 3,449,862 to A. J. Biro of June 17, 1969 for a window structure. This patent is directed specifically to a sliding meeting rail interlocking device and a side stabilizer. More particularly, it is directed towards a replacement window of a type which is not, however, suitable for screened-in porches and rooms where two-by-twos are used for the framing. Also attention is invited to U.S. Pat. No. 3,358,404 of Dec. 19, 1967 to D. J. Dinsmore which is directed to a readily removable double hung window. This patent discloses a counter-balancing unit of the type utilized in the instant invention but which is not claimed herein as such, as invention. Another prior art reference is U.S. Pat. No. 3,861,444 of Jan. 21, 1975 to J. E. Portwood which is directed to an extruded plastic window frame. The Portwood patent discloses an exterior mounting flange which is on the interior of the structure and has an offset flange whereby the window protrudes from the wall, a feature which is avoided in the instant invention.

SUMMARY OF THE INVENTION

The window of the invention is essentially of metal (aluminum) construction having individual panels with frames of less than one inch in thickness, two of such panels received in guides defined by the window frame. The frames both for the individual panels and for the window, as such, are constructed of extruded aluminum which provides stringers with grooves for receiving fastening screws, grooves for providing a complete weather sealing piles, space for receiving block and tackle sash balances which serve the dual purpose of counterbalancing the individual window panels and providing a lateral resilient force on each window panel allowing it to be positioned with ease. The extrusions also provide completely around the window frame a flange which may abut and be received flush between two by twos on existing screen porches or other supporting structure. Further provision is made by means of a double action leaf type stop connected to the window frame for disengaging the block and sash balances whereby the individual window panels can be removed by moving same laterally in a direction towards such block and tackle balances. The window so constructed withstands water resistant tests of up to 5.5 pounds per square foot, exterior wind load tests of up to 91 pounds per square foot, and interior wind load tests of up to 60.5 pounds per square foot with deformation of only 0.015 inches.

It is, therefore, a principal object of the present invention to provide a new and improved double hung window of the type described.

Another object is to provide a shallow double hung window which is only two inches in depth having the wind and water resistance described above.

A further object is to provide such a shallow double hung window wherein the frame, rails, stiles and bars are all constructed of extruded aluminum shapes.

Further objects and advantages will become apparent from the following detailed description taken in connection with the drawings, in which:

BRIEF DESCRIPTION OF THE DRAWINGS

FIG. 3 is a cross-sectional plan view of a portion of the embodiment of the invention illustrated in FIGS. 1 and 2 taken along the line 3—3 in FIG. 2.

FIGS. 4A, 4B, 4C, and 4D are broken perspective detailed views in partial section showing the upper and lower corner constructions of an individual panel;

FIGS. 4 and 6 are front and side view respectively of a plastic headpiece for the individual window panel frames;

FIGS. 9A and 9B are sectional side views illustrating the two positions for the double action leaf spring stop which disengages the block and tackle sash balances from the individual window panels in the position as shown in FIG. 9A;

DESCRIPTION OF THE PREFERRED EMBODIMENTS

Figure 1:
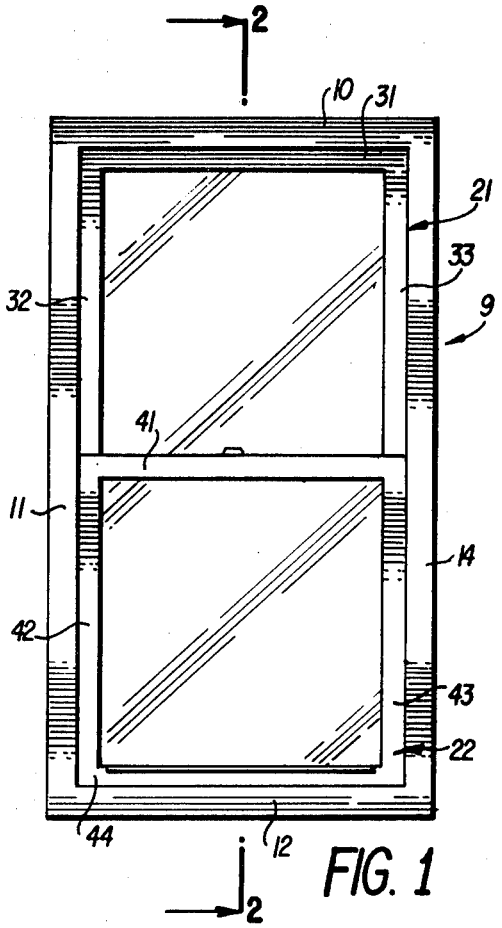
FIG. 1 is a front elevational view of a first embodiment of the present invention.

Although this invention may be embodied in different forms, there is shown in the drawings and will herein be described in detail, an embodiment of the invention with the understanding that the present disclosure is an exemplification of the principles of the present invention and is not intended to limit the scope of the invention to the specific embodiments illustrated. The scope of the invention will be set out in the appended claims.

Figure 2:
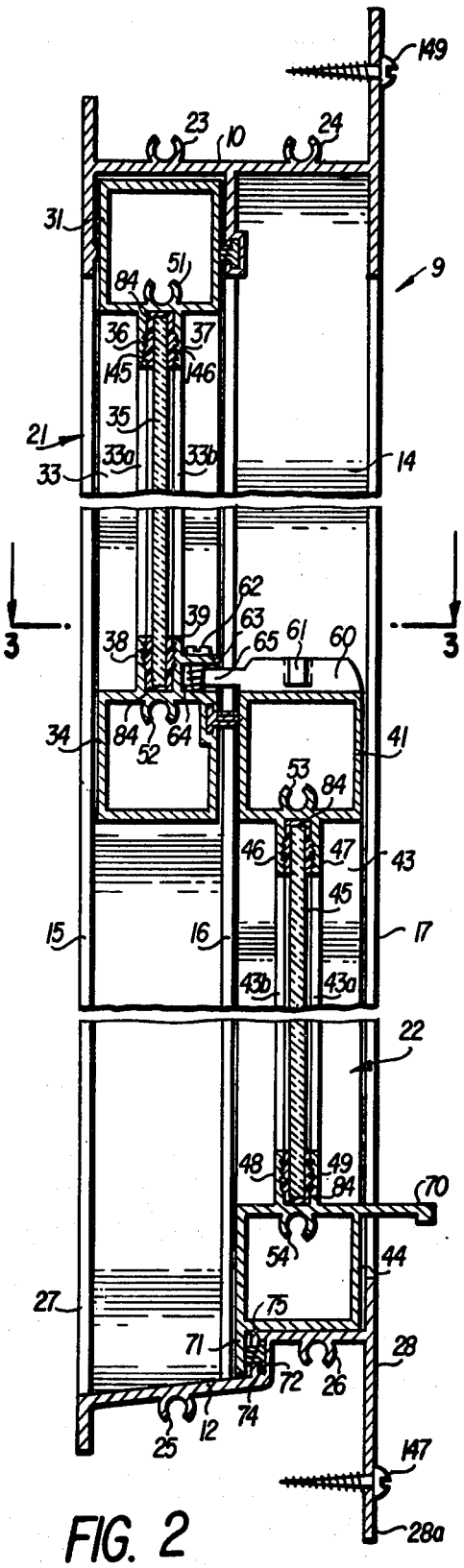
FIG. 2 is a cross-sectional elevation drawing of the invention illustrated in FIG. 1 taken along the line 202.
Figure 5:
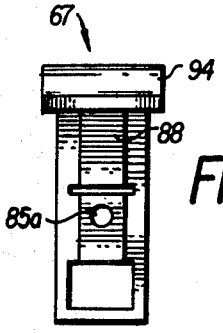
Figure 6:
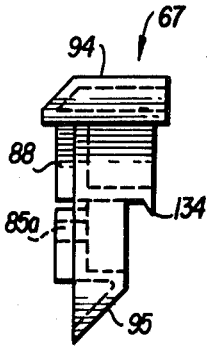

Referring to FIGS. 1 to 3, a window frame as seen from the interior generally indicated by reference numeral 9 comprises a top frame member 10 and a sill 12 joined by vertical jambs 11 and 14 having three vertical guides each 15, 16, and 17 extending normally in jamb 14 from a back plate 14*a*, and guides 18, 19 and 20 similarly extending from back plate 11*a*, jamb 11, for receiving an upper sash generally indicated by reference numeral 21 and a lower sash generally indicated by reference numeral 22. Spacer plates 15*a*, 16*a*, 18*a*, and 19*a* extend outwardly from guides 15, 16, 18, and 19 respectively. Members of frame 9 are stiffened by "C" shaped sections 23, 24, 25, and 26, which are adapted to receive metal screws. Top member 10, sill 12 and jambs 11 and 14 are preferably constructed of extruded aluminum bars with the "C" sections being an integral part thereof.

Frame 9 has an outer surface 27 and an inner surface 28. Surface 28 includes a perimeter part 28*a* which extends approximately five-eights of an inch farther outwardly beyond the perimeter of inner surface 28 on each side thereof as to facilitate mounting. Upper sash 21 consists of a top rail 31, vertical stiles 32 and 33, and a middle rail 34 which are secured together to form a rectangular frame which surrounds a glass pane 35 secured thereto by horizontal retainer plates 36, 37, 38, and 39, and vertical retainer plates 32*a*, 32*b*, 33*a*, and 33*b*. Such plates as indicated are integral extruded portions of the respective rails 31 and 34 and stiles 32 and 33. Lower sash 22 is composed of top rail 41, vertical stiles 42 and 43 identical to stiles 32 and 33, only stile 43 being shown in FIG. 2, and a bottom rail 44 which are secured together to form a rectangular frame which surrounds a glass pane 45 secured by retainer plates 46, 47, 48 and 49 and vertical retainer plates such as retainer plates 43*a* and 43*b* of stile 43. The rails and stiles, like the frame, are extruded aluminum shaped rods generally rectangular in shape and approximately seven-eights of an inch wide. Each is reinforced by a "C" shaped stringer which is an integral part of each rail and stile as indicated by "C" stringers 51, 52, 53, and 54. A latch 60 with an outwardly extending handle 61 is rotatably mounted on the top of top rail 41. A flange 63 extends outwardly from plate 39 forming an integral part of the middle rail 34 to provide a recess 64 which receives an extending portion 65 of latch 60 to lock the window in a closed position as indicated in Figures. It has been found helpful to reinforce the connection of the top of rail 34 and flange 63 by at least one metal screw 62 opposite or near where portion 65 is received in recess.

Inner surface 28 of frame 9 extends upwardly above sill 12 to overlap the bottom rail 44 of sash 22 as illustrated in FIG. 2. A flange 70 is mounted as an integral part of bottom rail 44 to extend inwardly over inner surface 28 of frame 9 whereby flange 70 may be utilized to raise and lower sash 22. Another flange 71 which forms an integral part of bottom rail 44 extends downwardly to mate with a central horizontal section 72 of the sill 12. A seal 74 is provided between flange 71 and rail sill 12 to provide a moisture and air barrier in a manner well known to those skilled in the art. Seal 74 is received in an extruded pocket 75 which is formed integral with sill 12.

With the thickness of the sashes being approximately seven-eights of an inch, the frame has a total depth of two inches. Perimeter part 28*a* which extends farther outwardly relative to outer surface 27 of frame 9 by about five-eights of inch provides an easy method of mounting the shallow hung window while at the same time giving a pleasing appearance.

FIGS. 4A, 4B, 4C and 4D illustrate the corner arrangement of the upper sash 21. Except for minor differences, the structure of the corners of the lower sash 22 are identical. Thus, it will be noted from FIG. 4A, the top rail 31 is provided with a rectilinear shaped notch 66 which receives the top of the vertical stile 33 just under and flush with the headpiece 77. It will be noted from FIG. 3, as well as FIG. 4B, stile 33 is provided with a rectangular extruded part 80 which surrounds a groove 81 of rectangular cross-section which receives a pile strip 82. Retainer plates 33*a* and 33*b* extend outwardly in a parallel relationship from the other side of vertical stile 33. Glass pane 35 is provided with wrap-around marine-type vinyl glazing 82 which is received within plates 36 and 37 and 33*a* and 33*b*. A bore 85 is provided on the interior face of vertical stile 33 which receives a self-threading screw 83 adapted to be threadably received within stringer 51 thus creating its own screw thread and drawing stile 33 against rail 31 within notch 66 whereby plates 33*a* and 33*b* grasp glazing 84 and engage retainer plates 36 and 37 to provide a strong 90° corner structure for the window panel involved. With references to the lower corner as indicated by FIGS. 4C and 4D, a further notch 68, similar to notch 66, is provided in rail 44 which receives the lower part of stile 33. Rail 34 is somewhat different from rail 44 in that it includes an extrusion part 86 of rectangular cross-section which defines a groove 87, also of rectangular cross-section, for receipt of a pile strip 90 similar to strip 82. Due to the presence of part 86, a recess 91 (actually an opening) is ground into the lower part of the stile 33 for receiving in a reasonably snug fashion part 86. Further, a bore 92 is provided in the interior face of stile 33 which is adapted to receive a self-threading screw similar to screw 83 which threads itself into the interior of stringer 52 whereby stile 33 is firmly secured within notch 66 and plates 33*a* and 33*b* grasp glazing 84 thus completing the corner construction as indicated in FIGS. 4C and 4D. It will be appreciated, as seen in FIGS. 4A, 4B, 4C, and 4D, the lefthand corner arrangements are essentially mirror images of those illustrated thus completing the frame for the window panel identified as sash 21. As previously indicated, the window frame for sash 22 is practically identical to that illustrated in FIGS. 4A–4D. But, there is, of course, no necessity to provide a recess such as recess 91 in the vertical stiles involved inasmuch as lower rail 44 does not include a part similar to part 86. Further, the inclusion of flanges 70 and 71 in rail 44 and also flange 63 adjacent rail 35 do not obscure the essential arrangement of components at the corner, flange 71 being coextensive with the vertical sides of rail 44.

Headpiece 67, received in the top of each of vertical stiles, includes a bore 85*a* which, when headpiece 67 is snugly received flush against the top of stile 33, it matches with the bore 85 to receive screw 83. Thus, headpiece 67 is secured firmly to vertical stile 33 and also to top rail 31 by screw 83. Headpiece 67, which is preferably composed of a hard wear resistant integral plastic part, is provided with a cap 94 which extends outwardly beyond the sides of vertical stile 33 and is flush with the sides of top rail 31 that define notch 66. It also includes a wedge shaped lower part 95. A protruding portion 88 is provided on the inward facing side of headpiece 67 to be received between guides 89 of the vertical stiles.

Figure 7:
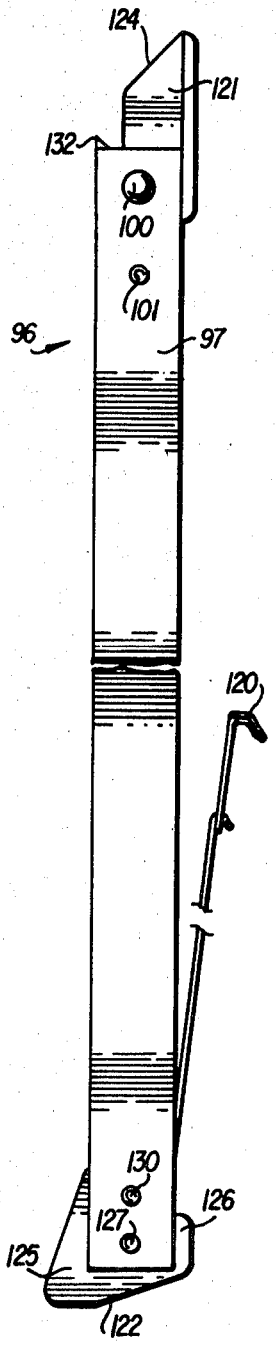
FIGS. 7 and 8 are side and front views respectively of block and tackle sash balances used with each individual window panel of the invention.
Figure 8:
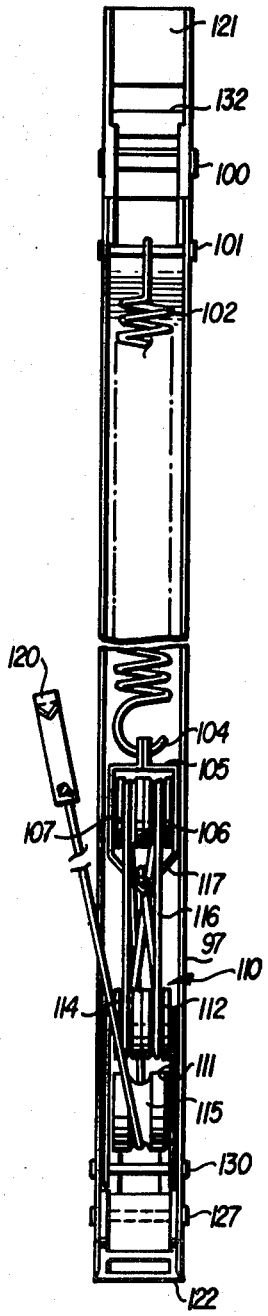

Block and tackle sash balances 96 as shown in FIGS. 7 and 8 are disposed between the vertical stiles such as stile 33 and stile 43 and back plate 14*a*. Each balance 96 includes an elongated rod 97 having a U-shaped cross section with a bolt 100 affixed in place across the upper end thereof. Spaced a short distance below bolt 100 is a further bolt 101 to which is connected a tension spring 102 that includes at its opposite ends a hook 104 to which is connected a pulley support 105. This support 105 rotatably supports a pair of pulleys 106 and 107 which form part of a block and tackle structure 110. Structure 110 includes also a lower pulley support 111 which rotatably supports a pair of pulleys 112 and 114 and a central pulley 115. A cable 116 is secured at one end to the lower portion of upper support 105 at location 117. Thereafter cable 116 is received by each of pulleys 106, 107, 112, and 114 in a manner well-known in the art to form a block and tackle, the end of which terminates with a hook member 120 where cable 116 is received by pulley 115.

Balance 96 includes an upper stop member 121 and a lower biasing member 122. Stop member 121 which is secured to the rod 97 by means of bolt 100 is wedge-shaped at the top including a planar surface 124 which extends substantially at the same angle relative to the horizontal as the angle shown in lower part 95 of headpiece 67. Stop member 121 is preferably composed of the same or similar material as that utilized for headpiece 67. Lower biasing member 122, which includes a toe portion 125 and a heel portion 126, is also made out of a similar material. It is secured to rod 97 by means of bolt 127 spaced thereabove a short distance is a bolt 130 to which is secured to the lower part of support 111.

In operation, toe 125 bears against guides 89 of vertical stile 33 or 43 as the case may be.

Figure 10:
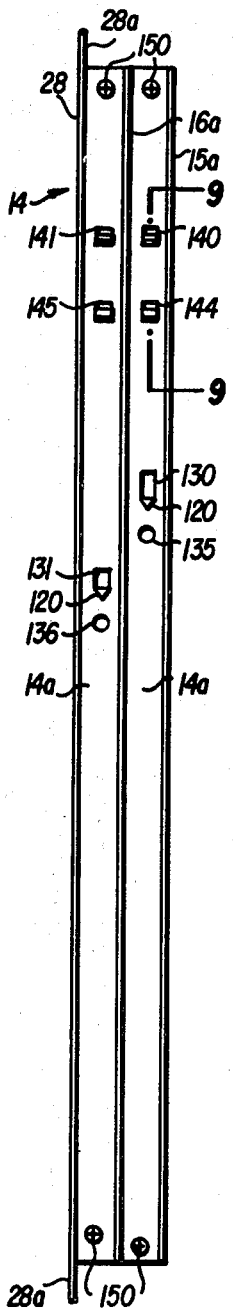
FIG. 10 is a side view of a window frame in accordance with the invention, the sectional view shown in FIGS. 9A and 9B being taken on section lines 9—9 of FIG. 10.

As seen from the side in FIG. 10, back plate 14*a* is provided with a pair of openings 130 and 131, opening 130 being higher and for receiving hook member 120 of balance 96 which is utilized for sash 21 whereas the lower opening 131 receives hook member 120 of balance 96 which is utilized for lower sash 22. As will be noted from FIG. 7 a tab 132, which is part of member 121, extends slightly upwardly beyond rod 97. Tab 132 cooperates with a further plastic tab 134 which extends downwardly from the outward face of each headpiece 67. Thus, with the members 120 of balances 96 in their respective openings 130 and 131, spring 102 urges member 121 upwardly whereby surface 124 engages lower portion 95 urging headpiece 67 in the associated sash laterally until the surfaces no longer are in contact whereby tab 132 engages and interlocks tab 134 so each spring 102 is urging its respective sash 21 and 22 in an upward direction. At the same time, toe 125 and heel 126 are received in the lower interior part of the vertical stile 33 and 43 again preventing more than limited movement of the stile towards the back plate 14*a*. Two further circular openings 135 and 136 are provided in plate 14*a* to allow room for a knot which connects each cable 116 to its respective support member 120. Four further horizontal slit-like openings 140, 141, 144 and 145 are also provided in back plate 14*a*, each set 140/144 and 141/145 to receive a separate double action leaf spring stop 142. Slots 140 and 141 and slits 144 and 145 are respectively at the same levels.

Each leaf spring stop 142 has two positions as shown in FIG. 9A and 9B whereby when in position as shown in FIG. 9A, the spring is pulled outwardly relative to the face 14*a* and acts to engage member 121, thus disengaging balance 96 from headpiece 67 and the associated stile. In this position, when the sash involved (sash 21 in this particular case) is moved still further upwardly, it can then be moved laterally to the right relative to FIG. 9A so that the lower rail no longer engages member 122 and headpiece 67 no longer engages balance 96. In such condition, the left side of the sash relative to FIG. 9A is moved whereby stile 32 for sash 21 is no longer confined by extensions 18 and 19 and thus the window panel can be removed. When each stop 142 is in position as shown in FIG. 9B, its thickness and width are such that stop member 121 straddles rather than engages same and therefore, the balance 96 continues to engage the associated sash whereby weight of the sash is balanced and at the same time, the sash cannot be removed from its corresponding groove, the grooves being defined by extensions 15, 16, and 17 on one side and 18, 19, and 20 on the other. Stop 142 is composed of a resilient spring steel and is not stable except in the two positions shown in FIG. 9A and 9B. However, it can be moved from one such position to the other easily by finger pressure. Thus, when in the position shown in FIG. 9A, with the corresponding sash pulled down to expose stop 142, it can be pushed to the position shown in FIG. 9B by simply pushing same by one's fingers. By the same token, when stop 142 is in the position shown in FIG. 9B and it is similarly exposed, it can be moved to the position shown in FIG. 9B by placing a fingernail or another between the lower part of the stop 142 and plate 14*a* and pulling. Hence, through the cooperation of balances 96 for each sash 21 and 22 and stops 142, each sash is permitted full up and down travel with its weight being supported by the associated balance 96 and with the lateral tension also being provided thus permitting the window to be held in any desired position. With the proper structural dimensions, neither lubrication nor adjustment is required.

All of the weather stripping such as, for example, strips 82 comprises a high-density pile type weather stripping. Such stripping is available in sizes and lengths whereby it can be easily cut and inserted into groove involved.

Glazing 84 is provided with ribs 145 which cooperate with groove 146 provided in each of the retainer plates, such as retainer plates 36 and 37, thus insuring that glazing 84 is held positively and firmly in position. Glazing 84, in turn, tightly grips panes 35 and 45 in a shock-resistant, non-rattling relationship and further provides an effective weather seal.

With frames for the individual sashes as well as the window frames as such all being extruded, the windows are easily manufactured to size quite simply by cutting the extruded frame parts at predetermined lengths according to the size required. In this connection, peripheral flange part 28*a* assists in locating and securing the windows to the 2×4's or otherwise by a series of screws 147 spaced around part 18*a* and received by the framing structure. If necessary or desired, sealing or insulating material is placed in the space formed by the surfaces 27 and 28 and frame guides 15*a*, 16*a*, 18*a* and 19*a* or the latter can be easily abraded or bent to narrow same as necessary to accommodate the framing structure. However, although this capacity exists, it is generally not necessary inasmuch as windows produced in accordance to the invention are easily accurately dimensioned according to specifications. A further advantage of the invention lies in the circumstance only eight screws are required to connect the window frame together as such; thus screws 150 (FIG. 10) are received in the stringers 23, 24, 25 and 26 in which they are self-threading and provide a strong connection for the frame. By the same token, each sash 21 and 22 requires only four screws 126 as previously described. In consequence, an entire window with two sashes may be entirely connected with a total of only sixteen screws, and then mounted to the framing structure by means of a plurality of screws 147.

Figure 11:
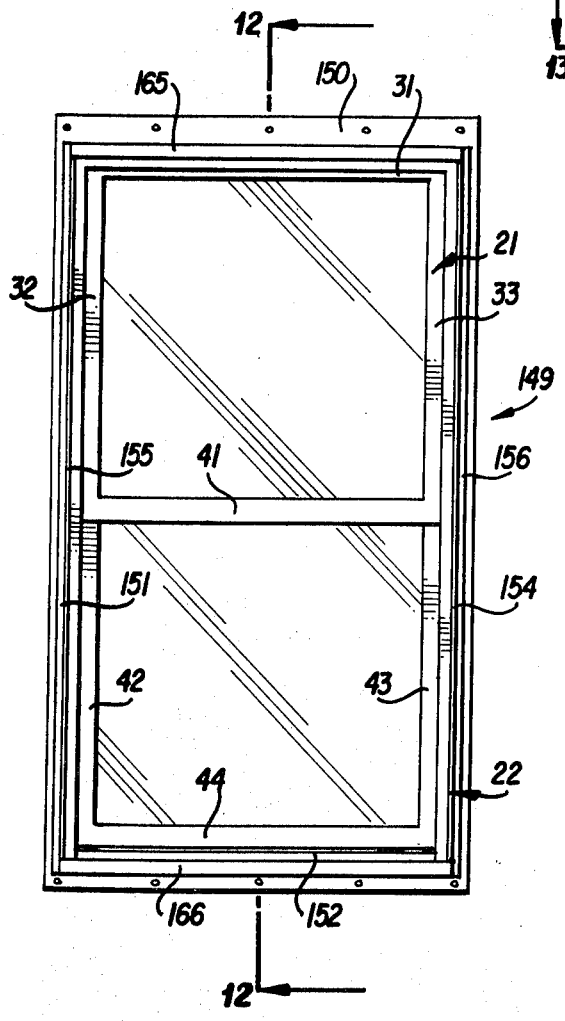
FIG. 11 is a front elevational view similar to FIG. 1 of a further embodiment of the invention.
Figure 12:
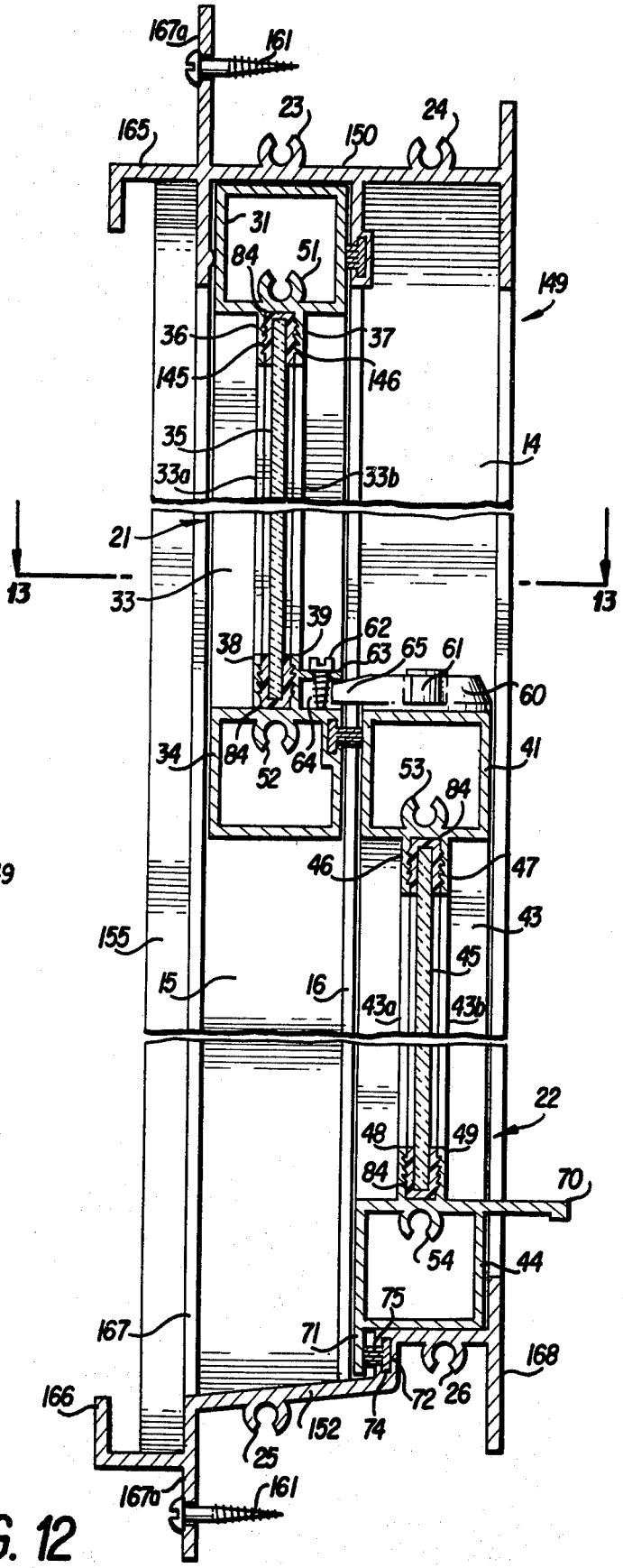
FIG. 12 is an elevational view in cross-section of the embodiment of FIG. 11 taken on lines 12—12 of FIG. 11.
Figure 13:
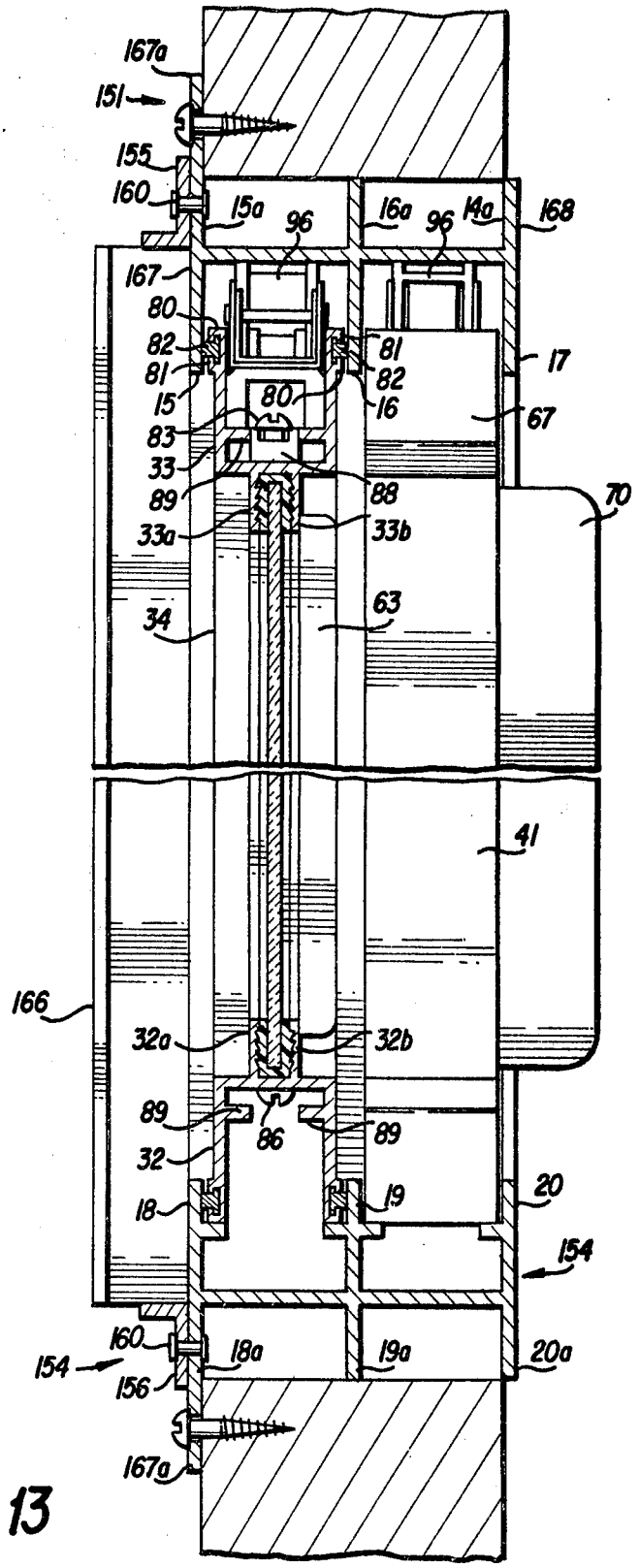
FIG. 13 is a plan view in section taken on line 13—13 of FIG. 12.

Referring to FIGS. 11 to 13, the window frame of a further preferred embodiment, as seen from the exterior, is generally indicated by reference numeral 148. It comprises a top frame member 150 and a still 152 joined by vertical jams 151 and 154. For identical or substantially identical components, the same reference numerals have been applied to this embodiment as to the first disclosed embodiment in FIGS. 1 through 10. This embodiment differs from the first embodiment primarily due to modifications whereby it may be installed and secured to the exterior of the wall structure receiving the window rather than the interior as with the first embodiment. The modification is obtained by providing a wider outer surface 167 in frame 149 than outer surface 27 of frame 9 and narrowing the perimeter of the inner surface 168 as compared to inner surface 28 of the first embodiment whereby the outer surface 167 includes a perimeter part 167*a* which extends approximately five-eights of an inch farther outward beyond the perimeter of the inner surface 168 on each side thereof to facilitate mounting.

In addition, sill 152 is provided with an outside flange 166 and top frame member 10 is provided with a similar opposing outside flange 165. It will be noted that both flanges 165 and 166 include 90° angles and on each side of the flanges aluminum angle beams 155 and 156 are provided. Either or both of angle beams 155 and 156 may be part of the extrusions for the respective vertical jambs 151 and 154. However, at least one such vertical beam 154 and 155 and preferably both in order to minimize the number of extrusions needed to construct the window are connected to their respective jambs 151 and 154 by self threading screws 160 received in jambs 151 and 154.

The purpose of flanges 165 and 166 together with angle beams 155 and 156 is to hold a screen or an outside pane for additional insulating reasons or some other type panel whereby soloar radiation may be reduced, enhanced or otherwise utilized.

The peripheral flange part 167*a* assists in locating and securing the windows to 2×4's or otherwise by a series of screws 161 spaced around part 167*a* and received by the framing structure.

Except for the provision of an outer rather than an inner peripheral flange part and the provision for receiving a panel for a screen or the like in the space defined by flanges 165 and 166 and angle beams 155 and 156, the embodiment shown in FIGS. 11 through 13 is essentially identical to that shown in FIGS. 1 through 10 and has substantially the same characteristics and advantages. Except for the differences disclosed, the same parts may be used interchangeably in the embodiments.

Windows as disclosed in accordance with the invention meet or exceed all South Florida Building Codes. One such test involved as aluminum double hung window thirty-eight inches in width by sixty-four inches in height overall. The window was glazed with double strength annealed glass using channel vinyl glazing. Single pile weather stripping was provided at each frame head, frame sill and the interior of the top vent bottom rail. A double pile was provided at each vent jamb rail. Spring and pulley balances were utilized as indicated and there were no muntins or weepholes. A plastic cam lock provided at the midspan of meeting rails with a one-eight by five-sixteenths inch slot in the lip of the cam lock. One plastic guide was provided at the top of each vent jamb rail. In order to meet specifications it was required that with the water resistance test there would be no leakage at 2.86 pounds per square foot; with the exterior wind load test that the window be capable of withstanding forty pounds per square foot; and for the interior wind load test that the window be capable of withstanding twenty pounds per square foot—all to be accomplished without permanent deformation of more than 0.14 inches. The window in accordance with the invention as described above met such test results showing no leakage at 5.5 pounds per square foot in the water resistance test; bearing a load of 91 pounds per square foot in the exterior wind load test and 60.5 pounds per square foot in the interior wind load test, the permanent deformation being only 0.015 inches. As a result of the tests, the aluminum double hung window as described was approved for elevations up to one hundred feet.

As previously indicated, the terminology used in the claims should be construed not only to cover the corresponding structure described in the specification but also equivalents thereof.

What is claimed is:

1. A pair of block and tackle sash balances in combination with a double hung window not greater than substantially two inches in over-all thickness, each balance comprising a rod having a U-shaped cross-section, a tension spring extending within said rod connected to one end thereof, a block and tackle mechanism within said rod connected to the other end of said spring, a cable of said block and tackle mechanism extending from the other end of said rod, the window comprising a jamb with a pair of inward grooves and a corresponding pair of outward grooves each defined by U-shaped sides provided side-by-side in said jamb, the outermost exterior facing said side of said jamp comprising a perimeter part having apertures for connective means therein which is coplanar and extends outwardly relative to the remainder of said jamb, a pair of window panels each with a stile having a U-shaped cross-section on one vertical side thereof, the legs of each said stile received in a corresponding said interior groove defining a longitudinal space having a substantially rectangular cross-section, each said stile defining an outwardly facing longitudinal groove at the outer end of each said leg thereof, a pile sealing strip received along the entire length of each said longitudinal groove, each said pile strip bearing against a corresponding side of an interior groove in said jamb whereby each said space is sealed, a said balance received in each said inward groove and having said cable affixed thereto whereby each said balance is urged upwardly, a headpiece attached to the top of each said stile, a stop member mounted on the top of each said rod, said stop member having an inclined surface adapted to cooperate with a mating inclined surface provided on said headpiece whereby the urging of said stop member against said headpiece urges said window panel in a lateral direction away from the corresponding said inward groove, said window being for installation on an existing framework of a porch or room wherein said framework consists essentially of beams having a thickness of substantially two inches.

2. A sash balance in accordance with claim 1 wherein a lower biasing means is mounted on the bottom of said rod whereby the upward urging of said rod by said spring positions said lower biasing means in said longitudinal space whereby it urges said window panel in a lateral direction away from the corresponding said inward groove.

3. A sash balance in accordance with claim 1, wherein a double action stop is mounted in the corresponding said inward groove which is adapted selectively to engage said stop member whereupon said stop member is disengaged from said headpiece and said window panel may be freely moved towards the corresponding said inward groove for removal of the panel from the remainder of the window.

4. A sash balance in accordance with claim 3, wherein said stop comprises a leaf spring having substantially an "h" shape as seen from the side, said leaf spring being mounted on two openings provided in the side of said jamb within the corresponding said inward groove and being stable in only positions of engaging said stop member or not in engagement therewith.

5. A double hung window comprising an aluminum extruded metal frame, said frame having a coplanar exterior portion defining a rectangular outer perimeter and an exterior window opening, the edges of said opening being at least about two inches from the outer edges of said perimeter, means spaced near the edges of said perimeter around said interior portion for fastening same to framing or the like of a building, said frame having a coplanar interior portion defining a further rectangular outer perimeter and an interior window opening which is directly aligned at least at the sides and top with said exterior window opening, said frame having a coplanar midway portion substantially midway between said exterior and interior portions which at least on the sides and top is directly aligned with said exterior and interior window openings, frame members perpendicular to said exterior, midway and interior portions which integrally join said portions whereby the maximum dimension between said exterior and interior portions is not in the excess of about two inches, a pair of sash members, one of said sash members slideably received between said exterior portion and said midway portion and the other said sash member slideably received between said interior portion and said midway portion, each said sash member carrying two vertical pile sealing strips at a vertical edge thereof and one of said sash members having a pile sealing strip extending from within its lower edge which is adapted to provide a seal between said sash members when the window is closed, and means for selectively securing said sash members together, the thickness of the extruded aluminum, the location of said pile sealing strips and the strength of said sash members when secured together by said securing means being sufficient to resist water leakage with water pressure of at least 2.86 pounds per square foot, and to sustain an exterior windload of at least forty pounds per square foot, an interior windload of at least twenty pounds per square foot with 0.14 inches maximum permanent deformation in a window as defined above which is about thirty-eight inches wide and sixty-four inches high overall.

6. A double hung window in accordance with claim 5 wherein the thickness and structure of the extruded aluminum and the strength construction of the sash members is sufficient to resist water leakage with a water pressure of at least about 5.5 pounds per square foot, and to sustain an exterior windload of at least 91 pounds per square foot, an interior windload of at least 60.5 pounds per square foot with 0.015 inches maximum permanent deformation in a window as defined above which is about 38 inches wide and 64 inches high overall.

7. A double hung window in accordance with claim 5, wherein means is provided on said exterior portion for receiving a panel.

* * * * *